US012429257B2

(12) United States Patent
Bradshaw et al.

(10) Patent No.: US 12,429,257 B2
(45) Date of Patent: Sep. 30, 2025

(54) HVAC SYSTEM WITH BYPASS CONDUIT

(71) Applicant: Johnson Controls Tyco IP Holdings LLP, Milwaukee, WI (US)

(72) Inventors: David Andrew Bradshaw, Timonium, MD (US); Cameron Stuart Nelson, Glen Rock, PA (US); Jeb William Schreiber, Stewartstown, PA (US); Seth Kevin Gladfelter, Red Lion, PA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 258 days.

(21) Appl. No.: 18/029,530

(22) PCT Filed: Sep. 30, 2021

(86) PCT No.: PCT/US2021/052980
§ 371 (c)(1),
(2) Date: Mar. 30, 2023

(87) PCT Pub. No.: WO2022/072704
PCT Pub. Date: Apr. 7, 2022

(65) Prior Publication Data

US 2023/0358448 A1 Nov. 9, 2023

Related U.S. Application Data

(60) Provisional application No. 63/085,842, filed on Sep. 30, 2020.

(51) Int. Cl.
*F25B 39/00* (2006.01)
*F25B 39/02* (2006.01)

(52) U.S. Cl.
CPC ..... *F25B 39/00* (2013.01); *F25B 39/028* (2013.01); *F25B 2339/021* (2013.01);
(Continued)

(58) Field of Classification Search
CPC .. F25B 39/00; F25B 39/028; F25B 2339/021; F25B 2339/024
See application file for complete search history.

(56) References Cited

U.S. PATENT DOCUMENTS 3,141,311 A * 7/1964 Mcgrath ..... F25B 1/053 62/305
3,191,396 A * 6/1965 Ruddock ..... F25B 1/053 62/226

(Continued)

FOREIGN PATENT DOCUMENTS

CN 104508435 A 4/2015
CN 104981665 A 10/2015

(Continued)

OTHER PUBLICATIONS

International Search Report and Written Opinion for PCT Application No. PCT/US2021/052980, mailed Jan. 21, 2022, 12 pages.

(Continued)

*Primary Examiner* — Marc E Norman
(74) *Attorney, Agent, or Firm* — Fletcher Yoder, PC

(57) ABSTRACT

A heating, ventilation, and/or air conditioning (HVAC) system includes a vessel configured to receive refrigerant from a condenser of the HVAC system, an evaporator configured to receive the refrigerant from the vessel, a first conduit configured to direct a first flow of the refrigerant to a first inlet of the evaporator, and a second conduit configured to direct a second flow of the refrigerant to a second inlet of the evaporator. The second inlet is above the first inlet relative to a vertical axis.

18 Claims, 8 Drawing Sheets

(52) U.S. Cl.
CPC . *F25B 2339/024* (2013.01); *F25B 2600/0253* (2013.01); *F25B 2600/2511* (2013.01)

(56) References Cited

U.S. PATENT DOCUMENTS

| | | | | |
|---|---|---|---|---|
| 3,270,521 | A * | 9/1966 | Rayner | F25B 31/002 62/505 |
| 3,299,653 | A * | 1/1967 | Osborne | F25B 1/053 62/115 |
| 3,553,974 | A | 1/1971 | Osborne | |
| 10,697,674 | B2 | 6/2020 | Schreiber et al. | |
| 2005/0097908 | A1 | 5/2005 | Lifson | |
| 2010/0326108 | A1 | 12/2010 | Schreiber et al. | |
| 2014/0102665 | A1 * | 4/2014 | Sibik | F25B 39/00 165/200 |
| 2017/0030594 | A1 * | 2/2017 | Robinson | F24H 15/215 |
| 2017/0102174 | A1 | 4/2017 | Chen et al. | |

FOREIGN PATENT DOCUMENTS

| | | | |
|---|---|---|---|
| JP | 2011002186 | A | 1/2011 |
| JP | 2012063120 | A | 3/2012 |
| JP | 2020079688 | A | 5/2020 |
| TW | M292059 | U | 6/2006 |
| WO | 2018183107 | A1 | 10/2018 |
| WO | 2018212983 | A1 | 11/2018 |
| WO | 2020186096 | A1 | 9/2020 |

OTHER PUBLICATIONS

Japanese Office Action for JP Application No. 2023-519835, dated Feb. 27, 2024, 5 pages.
European Extended Search Report for EP Application No. 21876518.8, dated Feb. 17, 2025, 7 pages.
Chinese Office Action for CN Application No. 202180069437.9, dated May 1, 2025, 14 pages.
Taiwan Office Action and Search Report for TW Application No. 110136573, dated Dec. 27, 2024, 15 pages.

* cited by examiner

HVAC SYSTEM WITH BYPASS CONDUIT

CROSS REFERENCE TO RELATED APPLICATION

This application is a U.S. National Stage Application of PCT International Application No. PCT/US2021/052980, entitled "HVAC SYSTEM WITH BYPASS CONDUIT," filed Sep. 30, 2021, which claims priority to and the benefit of U.S. Provisional Patent Application No. 63/085,842, entitled "HVAC SYSTEM WITH BYPASS CONDUIT," filed Sep. 30, 2020, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be noted that these statements are to be read in this light, and not as admissions of prior art.

Refrigeration systems are used in a variety of settings and for many purposes. For example, refrigeration systems may operate as a free cooling system and/or a mechanical cooling system to cool, heat, dehumidify, or otherwise condition a conditioning fluid. In some cases, the free cooling system may include a liquid-to-air heat exchanger, which is used in some heating, ventilating, and air conditioning applications. Additionally, the mechanical cooling system may include a vapor compression refrigeration cycle, which may circulate a refrigerant through a condenser, an evaporator, a compressor, an economizer, and/or an expansion device. In the condenser, the refrigerant is de-superheated, condensed, and/or subcooled, and the liquid or primarily liquid refrigerant may be directed to an economizer, where the pressure of the refrigerant may be reduced and cause a portion of the refrigerant to vaporize. The liquid refrigerant may be directed from the economizer to the evaporator, where the liquid refrigerant evaporates by absorbing thermal energy or heat from a conditioning fluid, such as an air flow and/or a cooling fluid (e.g., water), thereby cooling the conditioning fluid. In some applications, the vapor refrigerant may be directed from the economizer to the compressor to be re-pressurized. Under some operating conditions, a flow of refrigerant from the economizer to the evaporator may be limited or otherwise restricted.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a heating, ventilation, and/or air conditioning (HVAC) system includes a vessel configured to receive refrigerant from a condenser of the HVAC system, an evaporator configured to receive the refrigerant from the vessel, a first conduit configured to direct a first flow of the refrigerant to a first inlet of the evaporator, and a second conduit configured to direct a second flow of the refrigerant to a second inlet of the evaporator. The second inlet is above the first inlet relative to a vertical axis.

In an embodiment, a heating, ventilation, and/or air conditioning (HVAC) system includes a vessel configured to receive refrigerant from a condenser and to separate the refrigerant received from the condenser into vapor refrigerant and liquid refrigerant, a first conduit configured to direct a first flow of liquid refrigerant to a first inlet of an evaporator of the HVAC system, and a second conduit configured to direct a second flow of liquid refrigerant to a second inlet of the evaporator. The first conduit includes a bypass valve, and the second inlet is above the first inlet relative to a vertical axis. The HVAC system also includes a controller communicatively coupled to the bypass valve and configured to operate the bypass valve to control a flow rate of the first flow of liquid refrigerant to the evaporator via the first conduit.

In an embodiment, a heating, ventilation, and/or air conditioning (HVAC) system includes a condenser, an intermediate vessel configured to receive refrigerant from the condenser, an evaporator configured to receive the refrigerant from the intermediate vessel, a first conduit extending between the condenser and the intermediate vessel, a second conduit extending between the intermediate vessel and a first inlet of the evaporator, and a third conduit extending between the intermediate vessel and a second inlet of the evaporator. The first conduit includes an expansion valve configured to reduce a pressure of the refrigerant directed through the first conduit to enable separation of the refrigerant into liquid refrigerant and vapor refrigerant within the intermediate vessel, the second conduit is configured to direct the liquid refrigerant into the evaporator via the first inlet, the second inlet is above the first inlet relative to a vertical axis, and the third conduit is configured to direct the liquid refrigerant into the evaporator via the second inlet.

DRAWINGS

DETAILED DESCRIPTION

Figure 1:
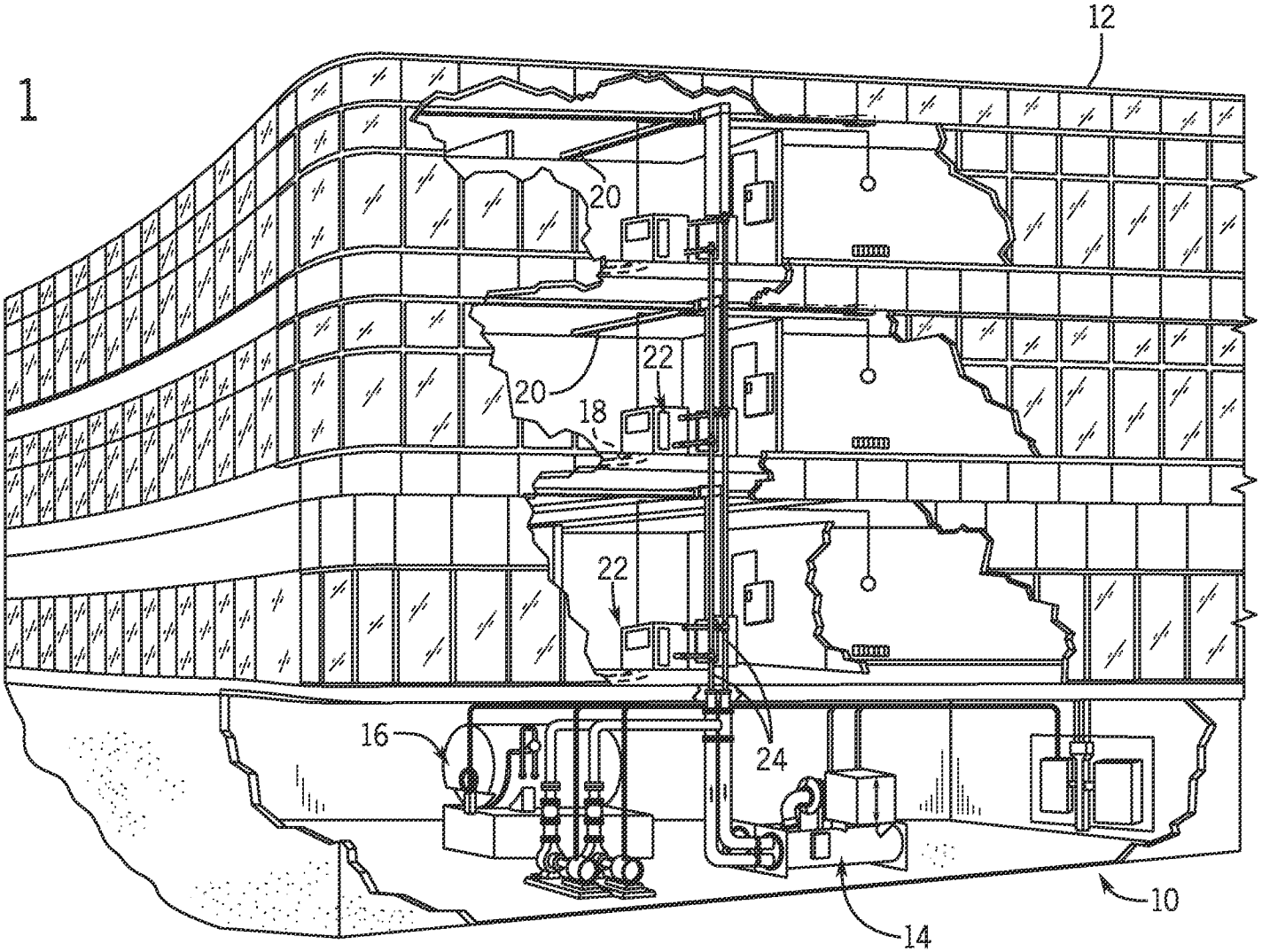
FIG. 1 is a perspective view of a building that may utilize an embodiment of a heating, ventilation, and air conditioning (HVAC) system in a commercial setting, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to an HVAC system configured to direct a refrigerant through a refrigerant circuit. The refrigerant may flow through multiple conduits and components disposed along the refrigerant circuit, while undergoing phase changes to enable the HVAC system to condition an interior space of a structure and/or a cooling fluid (e.g., water). For example, a refrigerant may be cooled via a condenser of the refrigerant circuit to transition from a vapor phase to a liquid phase. The refrigerant may be directed from the condenser toward an evaporator (e.g., a falling film evaporator) of the refrigerant circuit, where the refrigerant may transition from a liquid phase to a vapor phase within the evaporator to cool the cooling fluid (e.g., water) that is in a heat exchange relationship with the refrigerant. In some embodiments, the refrigerant circuit may include an economizer, which may receive the liquid refrigerant from the condenser and separate vapor refrigerant from the liquid refrigerant. The economizer may then direct the liquid refrigerant to the evaporator and block the vapor refrigerant from flowing to the evaporator in order to achieve a desired operation (e.g., efficiency) of the evaporator to cool the cooling fluid. The economizer may instead to direct the vapor refrigerant to a compressor of the refrigerant circuit for compression.

In some circumstances, the refrigerant may not readily flow into the evaporator. For example, in existing HVAC systems, a relatively high pressure in the condenser and/or the economizer may drive the refrigerant to flow into the evaporator. However, the refrigerant may not flow into the evaporator at a sufficient flow rate when a pressure differential between the economizer and the evaporator and/or a pressure differential between the condenser and the evaporator is low. More specifically, low pressure vapor refrigerant may collect or accumulate within a conduit extending between the economizer and the evaporator and/or at an expansion valve disposed between the economizer and the evaporator (e.g., disposed along the conduit extending between the economizer and the evaporator). For example, the pressure of the refrigerant in the condenser may be low, and the economizer may further lower the pressure of the refrigerant, which may reduce a flow rate of refrigerant into the evaporator and thereby reduce an operational efficiency of the HVAC system. Indeed, a low flow rate of refrigerant into the evaporator may cause unstable operation of certain components (e.g., the compressor) of the HVAC system.

Therefore, it is presently recognized that increasing the flow rate of refrigerant from the economizer to the evaporator may increase or maintain the operational efficiency of the HVAC system. As such, embodiments of the present disclosure are directed to an HVAC system having a refrigerant circuit with an economizer and a bypass line or conduit configured to enable an increase of refrigerant flow into the evaporator. For example, the bypass line may extend between the condenser and the evaporator or may extend between the economizer and the evaporator. The bypass line may facilitate flow of liquid refrigerant into the evaporator to increase the flow rate of refrigerant to the evaporator at low pressure differentials of the refrigerant within the refrigerant circuit. For instance, the bypass line may be arranged to enable a gravitational force and/or a pressure of the refrigerant (e.g., a head pressure or a difference in pressure between the condenser and the evaporator) to drive the liquid refrigerant to flow to the evaporator via the bypass line instead of via a primary line configured to direct refrigerant into the evaporator (e.g., from the economizer). The bypass line may include a valve configured to regulate an amount of refrigerant flowing through the bypass line. For example, the valve may be partially or completely open based on sensor data indicative of an operating parameter of the HVAC system to enable flow of refrigerant at a desirable rate through the bypass line (e.g., relative to a flow rate of liquid refrigerant directed through the primary line) into the evaporator. As noted above, in some embodiments, the bypass line fluidly couples (e.g., extends between) the economizer to the evaporator. In additional or alternative embodiments, the bypass line enables liquid to flow directly from the condenser to the evaporator without flowing through the economizer. The bypass line may increase the flow rate of refrigerant into the evaporator to increase or maintain an operational efficiency of the HVAC system, such as during instances of low and/or fluctuating head pressure (e.g., relatively low refrigerant pressure in the condenser and/or relatively high refrigerant pressure in the evaporator).

Turning now to the drawings, FIG. 1 is a perspective view of an embodiment of an environment for a heating, ventilation, and air conditioning (HVAC) system 10 in a building 12 for a typical commercial setting. The HVAC system 10 may include a vapor compression system 14 that supplies a chilled liquid, which may be used to cool the building 12. The HVAC system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC system 10. The HVAC system 10 is shown with a separate air handler on each floor of building 12, but in other embodiments, the HVAC system 10 may include air handlers 22 and/or other components that may be shared between or among floors.

Figure 2:
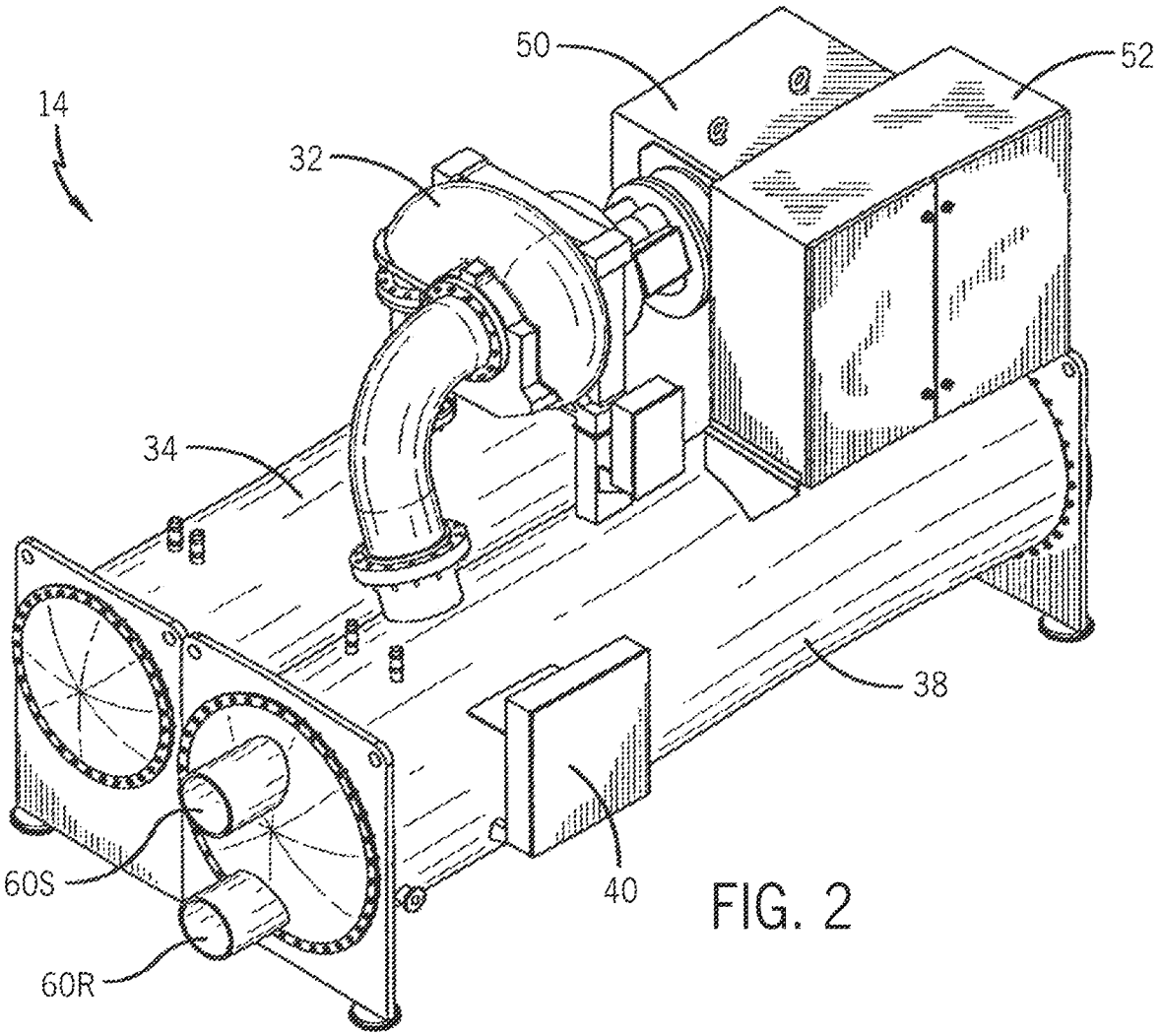
FIG. 2 is a perspective view of an embodiment of a vapor compression system, in accordance with an aspect of the present disclosure.
Figure 3:
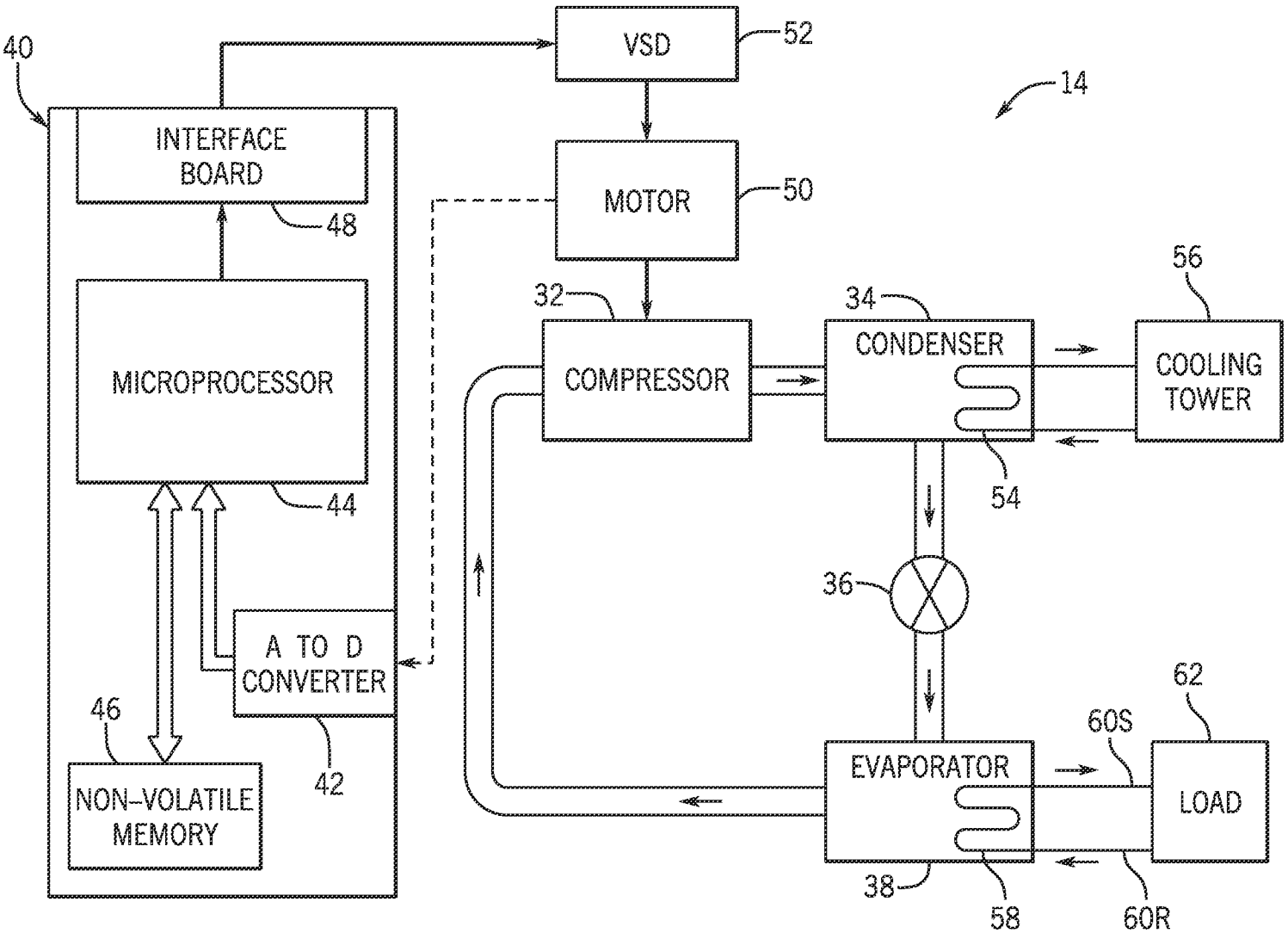
FIG. 3 is a schematic diagram of an embodiment of a vapor compression system, in accordance with an aspect of the present disclosure.

FIGS. 2 and 3 illustrate embodiments of the vapor compression system 14 that can be used in the HVAC system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 (e.g., controller) that has an analog to digital (A/D) converter 42, a microprocessor 44, a non-volatile memory 46, and/or an interface board 48.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The refrigerant liquid from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser.

The refrigerant liquid delivered to the evaporator 38 may absorb heat from another cooling fluid, which may or may not be the same cooling fluid used in the condenser 34. The refrigerant liquid in the evaporator 38 may undergo a phase change from the refrigerant liquid to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the refrigerant vapor exits the evaporator 38 and returns to the compressor 32 by a suction line to complete the cycle.

Figure 4:
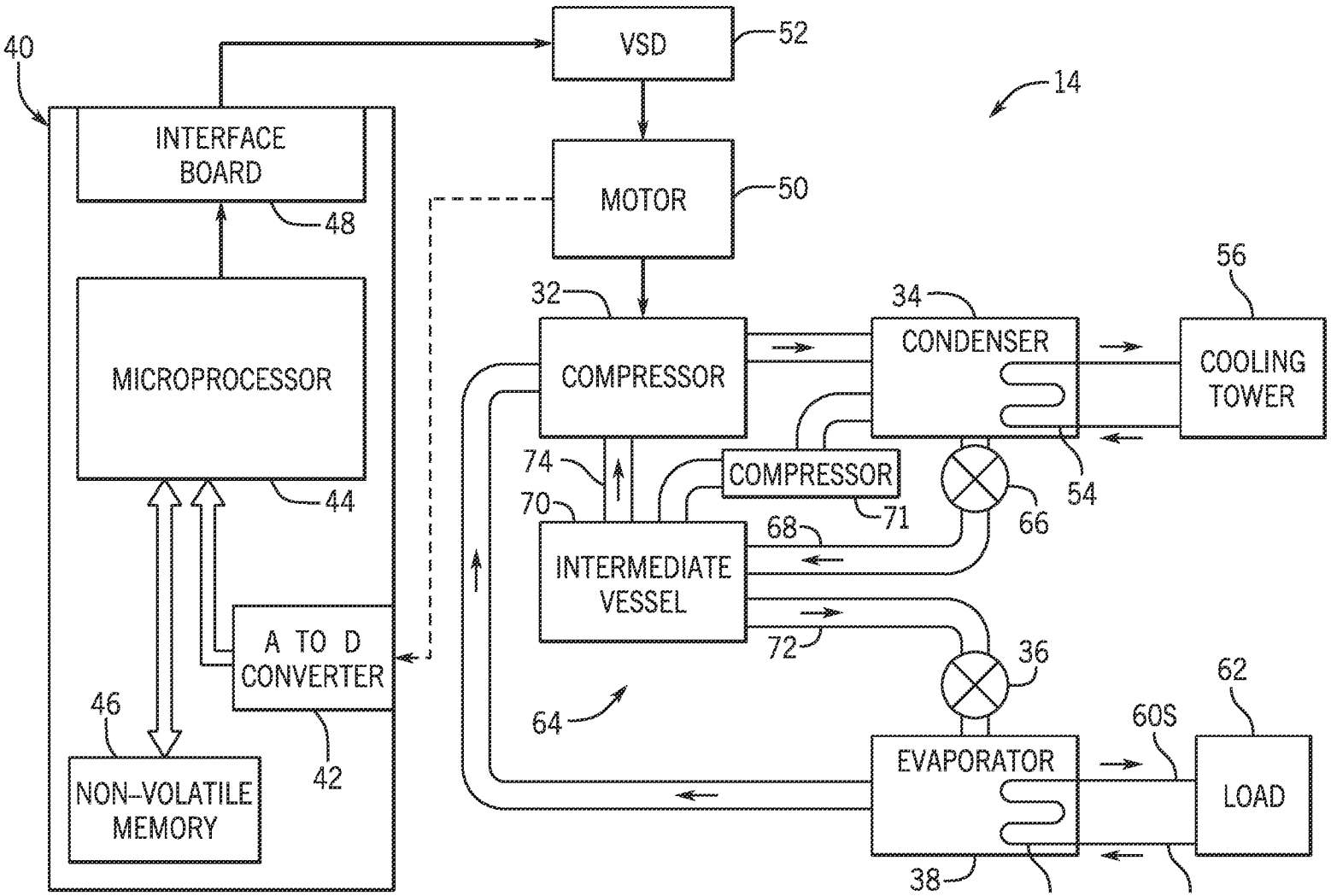
FIG. 4 is a schematic diagram of an embodiment of a vapor compression system, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line or conduit 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the refrigerant liquid received from the condenser 34. During the expansion process, a portion of the liquid may vaporize to enable separation of the refrigerant into liquid and vapor in the intermediate vessel 70. Additionally, the intermediate vessel 70 may provide for further expansion of the refrigerant liquid because of a pressure drop experienced by the refrigerant liquid when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel 70 may be drawn to an intermediate stage of the compressor 32 (e.g., not the suction stage). In further embodiments, the vapor compression system 14 may include an additional compressor 71 fluidly coupled to the intermediate vessel 70 to facilitate drawing vapor from the intermediate vessel 70. That is, the additional compressor 71 (e.g., a compressor having a smaller capacity than that of the compressor 32) may draw vapor from the intermediate vessel 70 to compress the vapor, and the second compressor 71 may discharge the compressed refrigerant to the condenser 34. Operation of the additional compressor 71 may facilitate operation of the compressor 32, such as by improving an efficiency of the operation of the compressor 32 and/or maintaining a structural integrity of the compressor 32. In any case, the liquid that collects in the intermediate vessel 70 may be at a lower enthalpy than the refrigerant liquid exiting the condenser 34 because of the expansion in the expansion device 66 and/or the intermediate vessel 70. The liquid from intermediate vessel 70 may then flow in line 72 through a second expansion device 36 to the evaporator 38.

In some embodiments, it may be advantageous to include a bypass line (e.g., a bypass conduit) within a vapor compression system to improve the efficiency of the vapor compression system, such as the vapor compression system 14. For instance, when a pressure differential in the vapor compression system 14 (e.g., between the intermediate vessel 70 and the evaporator 38 and/or between the condenser 34 and the evaporator 38) is relatively low, refrigerant (e.g., liquid refrigerant) may stack or accumulate in the intermediate vessel 70 and/or within a primary conduit extending from the intermediate vessel 70 to the evaporator 38 instead of readily flowing into the evaporator 38 (e.g., via the primary conduit). In some embodiments, the evaporator 38 of the vapor compression system 14 may be a falling film evaporator, which may be positioned at a greater height (e.g., relative to the condenser 34, relative to gravity) than other traditional systems and may restrict refrigerant flow from the intermediate vessel 70 to the evaporator 38. Due to the restricted refrigerant flow into the evaporator 38, an amount of cooling provided by the evaporator 38 may be limited or restricted and/or operation of other vapor compression circuit 14 components may be adversely affected.

Accordingly, the bypass line may direct at least a portion of refrigerant along an alternative flow path (e.g., different from a flow path provided by the primary conduit) that may provide less resistance to refrigerant flow than that of the primary conduit. In some embodiments, the bypass line may direct the refrigerant from the condenser 34 and/or the intermediate vessel 70 toward a bottom of the evaporator 38 to enable utilization of a gravitational force to direct the refrigerant through the bypass line to the evaporator 38. Additionally, a pressure from within the condenser 34 and/or the intermediate vessel 70 (e.g., a head pressure of refrigerant) may also contribute to directing the refrigerant through the bypass line to the evaporator 38. In certain embodiments, the bypass line may include a valve, and a control system of the vapor compression system 14, such as the control panel 40, may selectively actuate the valve to control a flow of the refrigerant to the evaporator 38 via the bypass line. By way of example, the control panel 40 may open, close, or otherwise adjust a position of the valve to improve the operating capacity, performance, and/or efficiency of the vapor compression system 14 (e.g., based on feedback or data received from other components of the vapor compression system 14).

Figure 5:
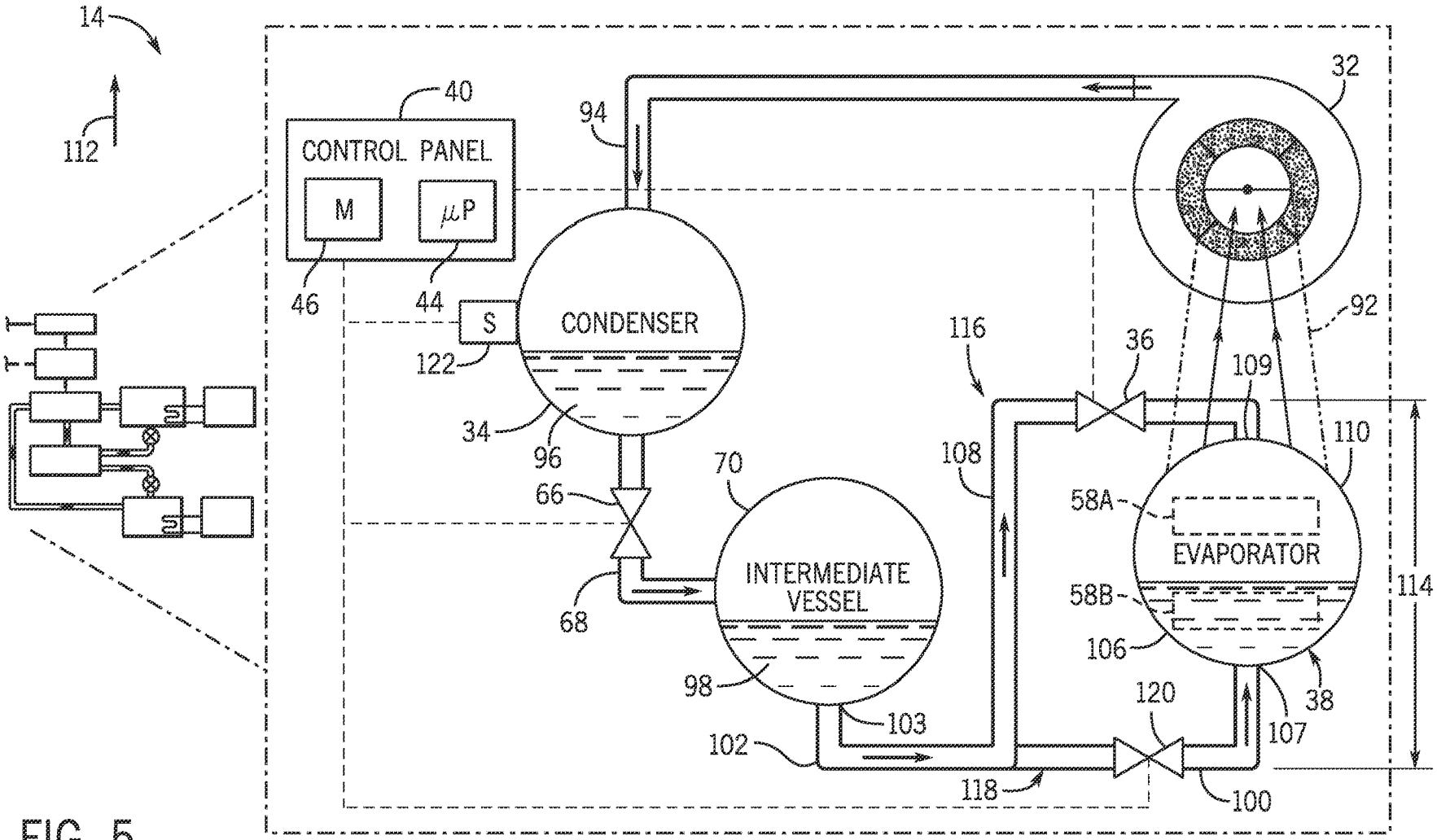
FIG. 5 is a schematic diagram of an embodiment of a vapor compression system having a bypass line, in accordance with an aspect of the present disclosure.

FIG. 5 is a schematic diagram of an embodiment of the vapor compression system 14 having the compressor 32, the condenser 34, the evaporator 38, and the intermediate vessel 70. During operation of the vapor compression system 14, the compressor 32 is configured to receive refrigerant (e.g., vapor refrigerant) from the evaporator 38 via a suction line or conduit 92, pressurize the refrigerant, and direct the pressurized refrigerant to the condenser 34 via a discharge line or conduit 94. The condenser 34 may cool the refrigerant and cause the refrigerant to accumulate as liquid refrigerant 96 in the condenser 34, and the liquid refrigerant 96 may be directed to the intermediate vessel 70, where a pressure of the liquid refrigerant 96 is reduced to cause the liquid refrigerant 96 to transition or "flash" into vapor refrigerant and liquid refrigerant 98. The intermediate vessel 70 may direct the liquid refrigerant 98 into the evaporator 38 to place the liquid refrigerant 98 in a heat exchange relationship with a cooling fluid to cool the cooling fluid. The reduced pressure of the liquid refrigerant 96 from the condenser 34 causes the liquid refrigerant 98 in the intermediate vessel 70 to have a lower temperature than that of the liquid refrigerant 96. In this way, the intermediate vessel 70 enables an increase in the cooling capacity of the evaporator 38. Further, the intermediate vessel 70 may block vapor refrigerant from being directed into the evaporator 38 to maintain efficiency of cooling provided by the evaporator 38. In some embodiments, the vapor refrigerant may be directed from the intermediate vessel 70 back to the compressor 32 (e.g., via the suction line 74 described with respect to FIG. 4) for re-pressurization.

The vapor compression system 14 further includes a bypass line or conduit 100 (e.g., a first line or conduit) extending between and fluidly coupling the intermediate vessel 70 and the evaporator 38. In the illustrated embodiment, the vapor compression system 14 includes a first outlet line or conduit 102 fluidly connected to an outlet 103 of the intermediate vessel 70 to enable the liquid refrigerant 98 (e.g., a portion of refrigerant in the intermediate vessel 70 that is in a liquid phase) to flow out of the intermediate vessel 70. The bypass line 100 extends between and fluidly couples the first outlet line 102 and a bottom section or portion 106 (e.g., a first inlet 107 of the evaporator 38 at the bottom section 106) of the evaporator 38. In this way, the liquid refrigerant 98 may flow from the intermediate vessel 70 through the first outlet line 102 and the bypass line 100 into the bottom section 106 of the evaporator 38. The illustrated vapor compression system 14 also includes a primary line or conduit 108 (e.g., a second line or conduit) extending between and fluidly coupling the first outlet line 102 and a top section or portion 110 (e.g., a second inlet 109 of the evaporator 38 at the top section 110) of the evaporator 38. Thus, the liquid refrigerant 98 may flow from the intermediate vessel 70 through the first outlet line 102 and the primary line 108 into the top section 110 of the evaporator 38. While each of the bypass line 100 and the primary line 108 is fluidly coupled to the same first outlet line 102 in the illustrated embodiment, in additional or alternative embodiments, the bypass line 100 and the primary line 108 may be separately coupled to the intermediate vessel 70 (e.g., to separate outlets of the intermediate vessel 70).

The bypass line 100 provides an additional flow path (e.g., a flow path at least partially distinct and separate from a flow path defined by the primary line 108) for the liquid refrigerant 98 to flow from the intermediate vessel 70 to the evaporator 38. The additional flow path provided by the bypass line 100 may impose less resistance to flow of the liquid refrigerant 98 as compared to that of the primary line 108. For instance, the primary line 108 may direct the liquid refrigerant 98 farther upward with respect to a vertical axis 112 (e.g., against a gravitational force) as compared to the liquid refrigerant 98 directed through the bypass line 100. That is, the second inlet 109 at the top section 110 of the evaporator 38 may be above the first inlet 107 at the bottom section 106 of the evaporator 38 relative to and along the vertical axis 112. Thus, less fluid pressure or force may be used to drive the liquid refrigerant 98 to flow through the bypass line 100 as compared to that through the primary line 108. Indeed, a height differential 114 between a top portion 116 of the primary line 108 and a bottom portion 118 of the bypass line 100, along with a pressure caused by the level of the liquid refrigerant 98 in the intermediate vessel 70, may more readily facilitate a flow of the liquid refrigerant 98 through the bypass line 100 into the evaporator 38. The bypass line 100 may be sized to enable the liquid refrigerant 98 to flow into the evaporator 38 at a desirable flow rate. For example, the bypass line 100 may have an approximately equal opening size (e.g., diameter) or a substantially smaller opening size (e.g., diameter) relative to the opening size (e.g., diameter) of the primary line 108. Alternatively, the bypass line 100 may have a substantially greater opening size (e.g., diameter) than that of the primary line 108.

Although the outlet 103 of the intermediate vessel 70 is below the first inlet 107 and the second inlet 109 of the evaporator 38 relative to the vertical axis 112 in the illustrated embodiment, the outlet 103 may be above the first inlet 107 and/or the second inlet 109 relative to the vertical axis 112 in additional or alternative embodiments. For example, at least a portion of the intermediate vessel 70 may be positioned above the evaporator 38 (e.g., above the second inlet 109). In such embodiments, the first inlet 107 may remain below the second inlet 109 such that the bypass line 100 imposes less resistance to flow of the liquid refrigerant 98 as compared to that of the primary line 108.

The evaporator 38 illustrated in FIG. 5 may be a hybrid falling film and flooded evaporator configured to operate as a falling film evaporator, a flooded evaporator, or both. For example, the evaporator 38 may operate as a falling film evaporator when the liquid refrigerant 98 flows through the primary line 108 and into the top section 110 of the evaporator 38 via the second inlet 109 of the evaporator 38 (e.g., without utilizing the bypass line 100 to direct the liquid refrigerant 98 to the evaporator 38). In some embodiments, flow of liquid refrigerant 98 through the bypass conduit 100 may be blocked during operation of the evaporator 38 as a falling film evaporator. The liquid refrigerant 98 may flow within the evaporator 38 from the top section 110 toward the bottom section 106, such as due to a gravitational force. The evaporator 38 may place the liquid refrigerant 98 in a heat exchange relationship with the cooling fluid (e.g., via tubes disposed within the evaporator 38 configured to direct the cooling fluid therethrough) to enable the liquid refrigerant 98 to cool the cooling fluid while flowing from the top section 110 toward the bottom section 106. After the cooling fluid is cooled within the evaporator 38, the cooling fluid may then be directed to conditioning equipment (e.g., a terminal unit, an air handler) in order to condition another fluid (e.g., air) with the cooling fluid.

Additionally, the evaporator 38 may operate as a flooded evaporator when the liquid refrigerant 98 flows through the bypass line 100 and into the bottom section 106 of the evaporator 38 via the first inlet 107 (e.g., when a pressure differential between the intermediate vessel 70 and the evaporator 38 is relatively small). That is, the liquid refrigerant 98 may accumulate at the bottom section 106. The evaporator 38 may place the liquid refrigerant 98 at the bottom section 106 in a heat exchange relationship with the cooling fluid to enable the liquid refrigerant 98 to cool the cooling fluid while accumulating at the bottom section 106. Further still, the evaporator 38 may operate simultaneously as both the falling film evaporator and the flooded evaporator (e.g., a hybrid falling film evaporator, or a hybrid flooded evaporator, and/or a hybrid falling film and flooded evaporator), such as when the liquid refrigerant 98 is directed through both the primary line 108 and the bypass line 100 into the top section 110 and the bottom section 106 of the evaporator 38, respectively. For example, the liquid refrigerant 98 may flow from the top section 110 to the bottom section 106 and also accumulate at the bottom section 106 within the evaporator 38 to exchange heat with the cooling fluid directed through the evaporator 38.

To this end and as briefly mentioned above, the evaporator 38 may include a first tube bundle 58A positioned below the second inlet 109 and through which the cooling fluid is directed. The liquid refrigerant 98 directed into the top section 110 of the evaporator 38 via the primary line 108 may flow or "fall" (e.g., via a gravitational force) over the tubes of the first tube bundle 58A to exchange heat with the cooling fluid directed through the first tube bundle 58A. That is, the liquid refrigerant 98 contacting the first tube bundle 58A may absorb thermal energy from the cooling fluid flowing through the first tube bundle 58A to cause some of the liquid refrigerant 98 directed into the evaporator 38 via the top section 110 to vaporize. The evaporator 38 may also include a second tube bundle 58B through which cooling fluid may also be directed, and the second tube bundle 58B may be surrounded by the liquid refrigerant 98 accumulating in the bottom section 106 of the evaporator 38, which may include the liquid refrigerant 98 directed to the bottom section 106 via the bypass line 100 and/or the liquid refrigerant 98 falling from the top section 110 of the evaporator 38 to the bottom section 106. As such, the second tube bundle 58B may be positioned below the first tube bundle and above the first inlet 107. The second tube bundle 58B may place the liquid refrigerant 98 in a heat exchange relationship with the cooling fluid flowing through the second tube bundle 58B at the bottom section 106 of the evaporator 38 to cause some of the liquid refrigerant 98 at the bottom section 106 to vaporize. In additional or alternative embodiments, the evaporator 38 may include another suitable type of evaporator instead of the hybrid falling film and flooded evaporator.

The illustrated primary line 108 may include the expansion valve 36, which reduces a pressure of the liquid refrigerant 98 flowing through the primary line 108 and adjusts a flow of the liquid refrigerant 98 (e.g., adjust a temperature and/or pressure of the liquid refrigerant 98) from the first outlet line 102 to the top section 110 of the evaporator 38. The bypass line 100 may include a bypass valve 120, which may regulate and/or selectively enable flow of the liquid refrigerant 98 through the bypass line 100 into the evaporator 38. The expansion valve 36, the expansion valve 66, and/or the bypass valve 120 may be communicatively coupled to the control panel 40, such as the microprocessor 44 of the control panel 40. The microprocessor 44 (e.g., processing circuitry) may be configured to adjust a position of the expansion valve 36, the expansion valve 66, and/or the bypass valve 120, such as based on operating conditions or parameters (e.g., received by the control panel 40 as feedback, such as sensor feedback) of the vapor compression system 14. For example, the memory 46 may include volatile memory, such as random-access memory (RAM), and/or non-volatile memory, such as read-only memory (ROM), optical drives, hard disc drives, solid-state drives, or any other non-transitory computer-readable medium storing instructions that, when executed, control operation of the vapor compression system 14, including to control operation of the expansion valve 36, the expansion valve 66, and/or the bypass valve 120. The microprocessor 44 (e.g., processing circuitry) may be configured to execute such instructions stored in the memory 46. As an example, the microprocessor 44 may include one or more application specific integrated circuits (ASICs), one or more field programmable gate arrays (FPGAs), one or more general purpose processors, or any combination thereof.

In some embodiments, the vapor compression system 14 may include one or more sensors 122 configured to detect or determine an operating parameter (e.g., refrigerant pressure, refrigerant temperature, operating capacity) of the vapor compression system 14. The control panel 40 may be communicatively coupled to the sensor(s) 122 in order to receive sensor data from the sensor(s) 122, and the control panel 40 may operate based on the sensor data, such as to adjust the position of (e.g., to open and/or close) the expansion valve 36 and/or the bypass valve 120. By way of example, the sensor data may be indicative of a pressure within the evaporator 38, a discharge pressure of the compressor 32, a pressure within the condenser 34, a pressure differential within the vapor compression system 14 (e.g., between the intermediate vessel 70 and the evaporator 38), a level of the liquid refrigerant 96 within the condenser 34, and/or a flow rate of refrigerant into the evaporator 38 (e.g., via the second inlet 109 at the top section 110). Indeed, the control panel 40 may compare the sensor data to one or more threshold values (e.g., pressure values, pressure differential values, flow rate values) to determine whether any of the expansion valve 36, the expansion valve 66, and/or the bypass valve 120 is to be adjusted. Furthermore, the sensor data may be indicative of the respective positions of the expansion valve 36, the expansion valve 66, and/or the bypass valve 120, and the control panel 40 may therefore use the sensor data to determine whether the expansion valve 36, the expansion valve 66, and/or the bypass valve 120 are set in desirable positions. To this end, the one or more sensors 122 may be coupled to and/or disposed at the compressor 32, the condenser 34, the evaporator 38, the expansion valve 36, the expansion valve 66, the bypass valve 120, the first outlet line 102, the bypass line 100, the primary line 108, any other suitable location of the vapor compression system 14, or any combination thereof.

By way of example, the control panel 40 may adjust the position of the expansion valve 36, the expansion valve 66, and/or the bypass valve 120 to maintain desirable flow of the liquid refrigerant 98 into the evaporator 38. For instance, during low pressure differential conditions, the control panel 40 may operate to maintain the flow of the liquid refrigerant 98 into the evaporator 38 above a threshold flow rate.

Moreover, during conditions in which the pressure differential within the vapor compression system 14 (e.g., between the intermediate vessel 70 and the evaporator 38) is fluctuating and affects the drive of the liquid refrigerant 98 through the primary line 108, the control panel 40 may operate to regulate the flow of the liquid refrigerant 98 at a constant or sufficient flow rate in response to the fluctuating pressure differential. The control panel 40 may also adjust the position of the expansion valve 36, the expansion valve 66, and/or the bypass valve 120 to stabilize a level of the liquid refrigerant 96, 98 in the condenser 34 and/or the intermediate vessel 70, respectively. That is, controlling a flow rate of the liquid refrigerant 98 directed into the evaporator 38 may affect a flow rate of the liquid refrigerant 98 directed out of the intermediate vessel 70 and a flow rate of the liquid refrigerant 96 directed out of the condenser 34 into the intermediate vessel 70. As such, the control panel 40 may control the valves 36, 66, 120 based on the flow rate of the liquid refrigerant 96, 98 directed out of the condenser 34 and/or the intermediate vessel 70, respectively, relative to a flow rate of refrigerant directed into the condenser 34 and/or the intermediate vessel 70 to control the level of the liquid refrigerant 96, 98 in the condenser 34 and the intermediate vessel 70, respectively.

The operation of the control panel 40 may also improve a structural integrity of the components of the vapor compression system 14. By way of example, control of the valves 36, 66, 120 may enable the liquid refrigerant 98 to be directed into the evaporator 38 at a desirable flow rate without reducing the pressure within the evaporator 38 (e.g., by adjusting operation of the compressor 32) to increase the pressure differential within the vapor compression system 14 (e.g., between the intermediate vessel 70 and the evaporator 38). Reducing the pressure within the evaporator 38 may cause freezing of the cooling fluid, which may impact the structural integrity of the evaporator 38. Thus, controlling the flow rate of the liquid refrigerant 98 into the evaporator 38 by controlling the valves 36, 66, 120 instead of by reducing the pressure within the evaporator 38 may block freezing of the cooling fluid, thereby improving the structural integrity of the evaporator 38.

The vapor compression system 14 may also be configured to operate in a free-cooling mode to reduce energy consumption of the vapor compression system 14. As an example, the control panel 40 may operate the vapor compression system 14 in the free-cooling mode in response to ambient temperature and/or a temperature of a conditioning fluid directed through the condenser 34 (e.g., to cool the liquid refrigerant 96) falling below a threshold value. As another example, the control panel 40 may operate the vapor compression system 14 in response to a temperature within the condenser 34 (e.g., a conditioning fluid and/or refrigerant temperature) being lower than a temperature within the evaporator 38 (e.g., a cooling fluid and/or refrigerant temperature). Indeed, control of the valves 36, 66, 120 may enable the liquid refrigerant 98 to be directed into the evaporator 38 at a desirable flow rate without operating the condenser 34 at an elevated or increased temperature and/or pressure (e.g., to achieve a desirable pressure differential between the intermediate vessel 70 and the evaporator 38). Thus, the vapor compression system 14 may be configured to operate in the free-cooling mode, in which the condenser 34 may be at a reduced temperature and/or pressure, and nonetheless direct the liquid refrigerant 98 into the evaporator 38 at a desirable rate (e.g., without increasing the temperature and/or pressure within the condenser 34).

During the free-cooling mode, the control panel 40 may reduce power consumption of the compressor 32 by suspending operation of the compressor 32 or operating the compressor 32 at a reduced capacity, thereby reducing a pressurization of the refrigerant entering the condenser 34. In this manner, during the free-cooling mode, a pressure differential within the vapor compression system 14 (e.g., between the intermediate vessel 70 and the evaporator 38 and/or between the condenser 34 and the evaporator 38) may be relatively low (e.g., compared to non-free-cooling operation). The bypass line 100 may facilitate operation of the vapor compression system 14 in the free-cooling mode by providing a flow path for the liquid refrigerant 98 to be directed to the evaporator 38 with limited mechanical force (e.g., a pressure differential created via the compressor 32). For example, a temperature differential between the evaporator 38 and the condenser 34 may drive vapor refrigerant to flow from the evaporator 38 through the suction line 92, through the compressor 32, through the discharge line 94, and into the condenser 34. The vapor refrigerant then condenses to a liquid via heat exchange with the conditioning fluid and accumulates as the liquid refrigerant 96 in the condenser 34. Thereafter, the liquid refrigerant 96 is directed into the intermediate vessel 70, where the liquid refrigerant 96 partially vaporizes to form vapor refrigerant and partially accumulates as the liquid refrigerant 98.

When the bypass valve 120 is at least partially open, the bypass line 100 may enable the liquid refrigerant 98 to flow from the intermediate vessel 70 to the evaporator 38 via gravitational force and/or via a pressure within the intermediate vessel 70. In this manner, the bypass line 100 and the bypass valve 120 may enable the liquid refrigerant 98 to be adequately directed through the vapor compression system 14 into the evaporator 38 during reduced or suspended operation of the compressor 32 (e.g., during a free cooling operation of the vapor compression system 14), thereby reducing energy consumption and/or cost of operating the vapor compression system 14. That is, the liquid refrigerant 98 directed through the bypass line 100 may flow into the evaporator 38 without overcoming a force of gravity to flow through the primary line 108 along the height differential 114 to the top section 110 of the evaporator 38. In this way, the bypass line 100 extending between the intermediate vessel 70 (e.g., the first outlet line 102) and the evaporator 38 enables improved operation of the vapor compression system 14 (e.g., operation of the vapor compression system 14 at greater efficiency).

Figure 6:
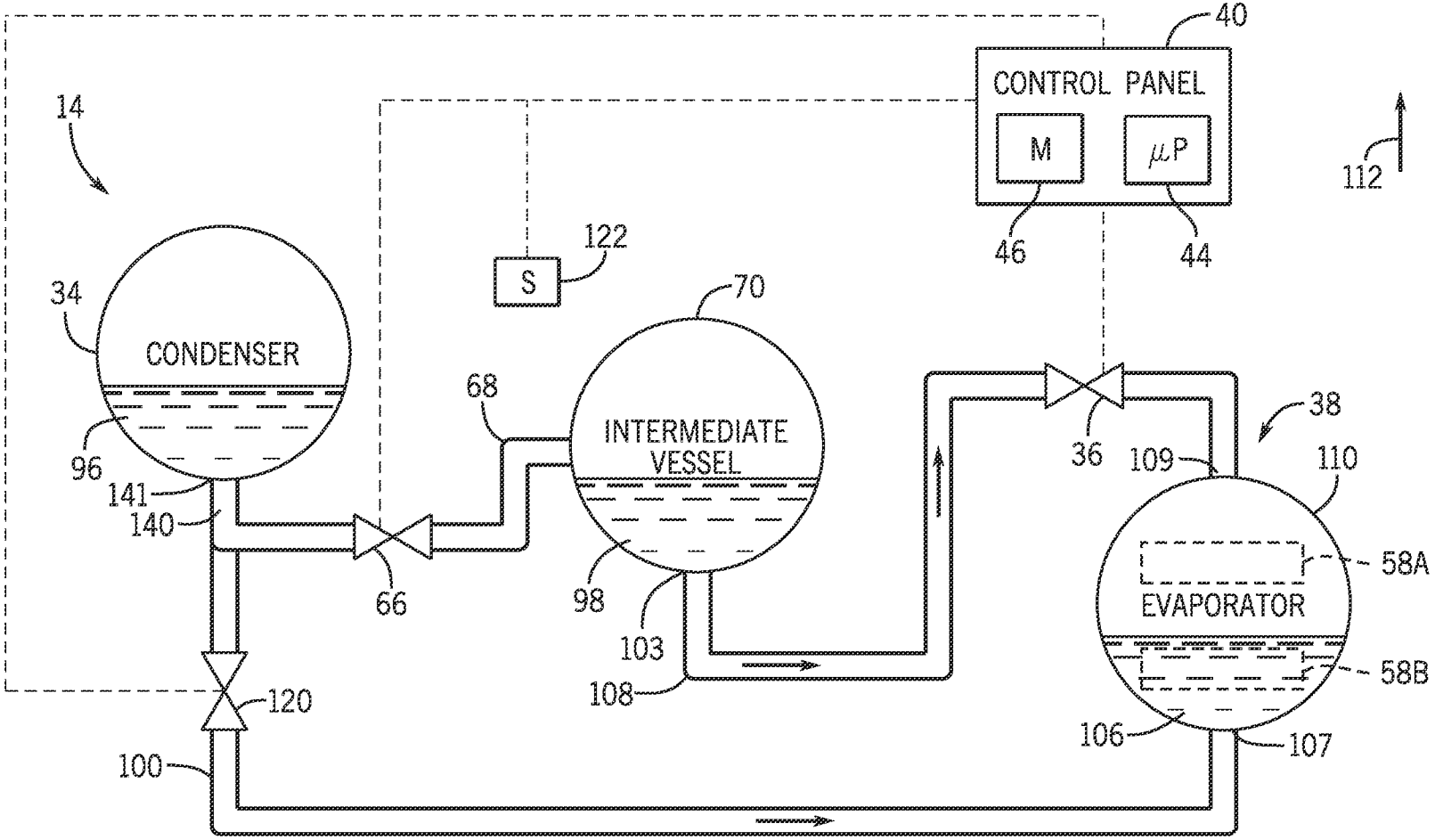
FIG. 6 is a schematic diagram of an embodiment of a vapor compression system having a bypass line, in accordance with an aspect of the present disclosure.

FIG. 6 is a schematic diagram of an embodiment of a portion of the vapor compression system 14, illustrating the bypass line 100 extending between the condenser 34 and the evaporator 38 (e.g., the bottom section 106 of the evaporator 38) to enable the liquid refrigerant 96 to flow from the condenser 34 directly to the evaporator 38. That is, the bypass line 100 does not extend between the evaporator 38 and the intermediate vessel 70, as shown in FIG. 5, thereby enabling the liquid refrigerant 96 bypass of the intermediate vessel 70. For instance, a second outlet line or conduit 140 may extend from an outlet 141 the condenser 34 (e.g., at a base or bottom section of the condenser 34) to enable the liquid refrigerant 96 to flow out of the condenser 34. Each of the inlet line 68 and the bypass line 100 may extend from and be fluidly coupled to the second outlet line 140. In additional or alternative embodiments, the bypass line 100 and the inlet line 68 may be separately coupled to the condenser 34 (e.g., to separate outlets of the condenser 34). In any case, a first portion of the liquid refrigerant 96 may flow to the evaporator 38 via the bypass line 100, and a second portion of the liquid refrigerant 96 may flow to the evaporator 38 via the inlet line 68, the intermediate vessel 70, and the primary line 108. In this way, the liquid refrigerant 96 flowing through the bypass line 100 does not flow through the expansion valve 66 and into the intermediate vessel 70.

The vapor compression system 14 illustrated in FIG. 6 may operate in accordance with the techniques described above with respect to FIG. 5. For example, the control panel 40 may operate the expansion valve 36, the expansion valve 66, and/or the bypass valve 120 based on sensor data received from the one or more sensors 122, such as to operate the evaporator 38 as a falling film evaporator by opening the expansion valve 66 and the expansion valve 36 to direct the liquid refrigerant 96, 98 into the top section 110 of the evaporator 38 and/or to operate the evaporator 38 as a flooded evaporator by opening the bypass valve 120 to direct the liquid refrigerant 96 into the bottom section 106 of the evaporator 38. Indeed, in some modes of operation, the control panel 40 may completely close the expansion valve 36 and/or the expansion valve 66 to block the liquid refrigerant 96, 98 from flowing into the top section 110 of the evaporator 38, thereby operating the evaporator 38 as a flooded evaporator. The control panel 40 may also at least partially open the expansion valve 36, the expansion valve 66, and/or the bypass valve 120 to operate the evaporator 38 as a hybrid falling film and flooded evaporator. In other words, the control panel 40 is configured to control operation of the expansion valve 36, the expansion valve 66, and/or the bypass valve 120 to enable desired flow rates of the liquid refrigerant 96 and/or 98 into the evaporator 38 via the first inlet 107 and/or the second inlet 108 (e.g., based on feedback from the one or more sensors 122).

Figure 7:
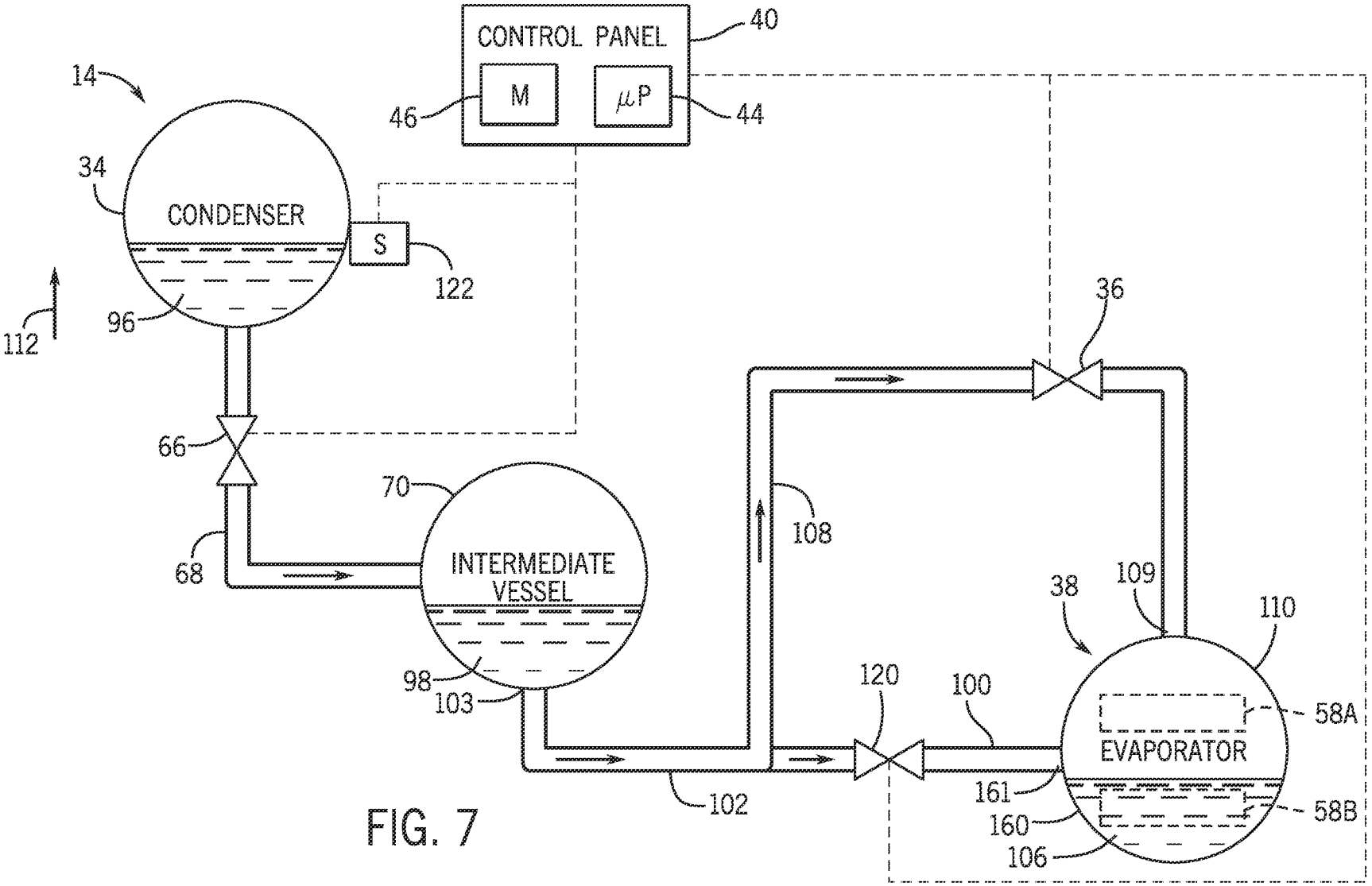
FIG. 7 is a schematic diagram of an embodiment of a vapor compression system having a bypass line, in accordance with an aspect of the present disclosure.

FIG. 7 is a schematic diagram of an embodiment of a portion of the vapor compression system 14, illustrating the bypass line 100 extending between the first outlet line 102 to a side section or portion 160 (e.g., a third inlet 161 at the side section 160) of the evaporator 38. For example, the positioning of the intermediate vessel 70 relative to the evaporator 38 and/or the pressure differential within the vapor compression system 14 (e.g., between the intermediate vessel 70 and the evaporator 38) may enable the liquid refrigerant 98 to flow into the side section 160 instead of the bottom section 106 of the evaporator 38 that is below the side section 160 relative to the vertical axis 112. That is, even though the gravitational force and/or the pressure differential within the vapor compression system 14 may enable the liquid refrigerant 98 to flow into the evaporator 38 at a greater flow rate via the bottom section 106 as compared to via the side section 160, the implementation of the vapor compression system 14 may enable the liquid refrigerant 98 to flow into the evaporator 38 at a desirable flow rate via the side section 160 (e.g., without directing the liquid refrigerant 98 to flow at an increased flow rate into the evaporator 38 via the bottom section 106).

The liquid refrigerant 98 flowing through the bypass line 100 into the evaporator 38 via the side section 161 may flow over a portion or subset of the first tube bundle 58A at the top section 110 to enable the evaporator 38 to operate partially as a falling film evaporator. Moreover, the liquid refrigerant 98 directed into the evaporator 38 may accumulate at the bottom section 106 of the evaporator 38 to at least partially surround the second tube bundle 58B of the evaporator 38 at the bottom section 106 and enable the evaporator 38 to operate as a flooded evaporator. Accordingly, directing the liquid refrigerant 98 into the evaporator 38 via the bypass line 100 fluidly coupled to the side section 160 may enable the evaporator 38 to operate as both the falling film evaporator and the flooded evaporator. In some embodiments, the configuration of the bypass line 100 illustrated in FIG. 7 may avoid directing the liquid refrigerant 98 into the evaporator 38 in an upward direction (e.g., against gravity, along the vertical axis 112) and further reduce flow resistance of the liquid refrigerant 98 into the evaporator 38. Furthermore, the control panel 40 may operate the illustrated vapor compression system 14 using the techniques described above, such as to operate the expansion valve 36, the expansion valve 66, and/or the bypass valve 120 based on sensor data received from the one or more sensors 122.

Figure 8:
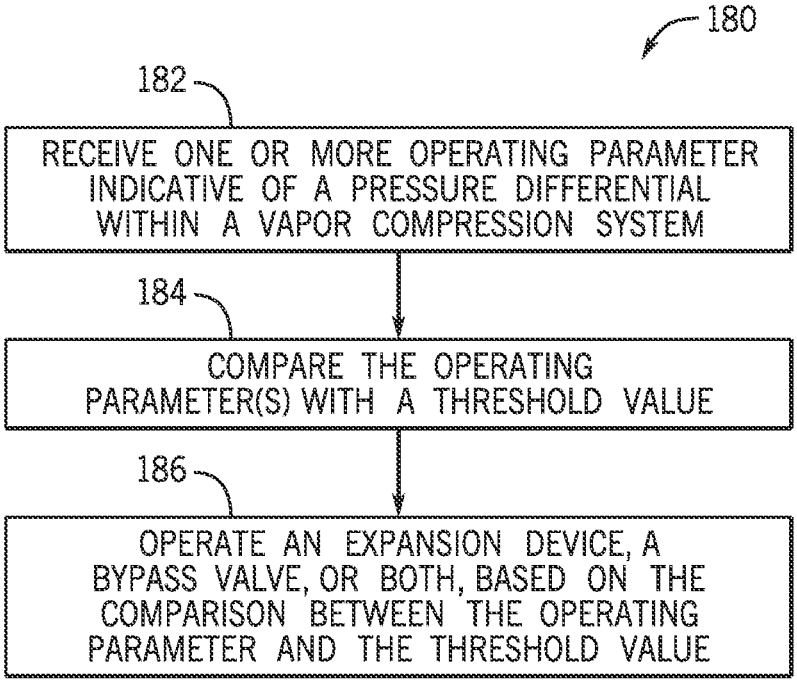
FIG. 8 is a flowchart of an embodiment of a method or process for operating a vapor compression system having a bypass line, in accordance with an aspect of the present disclosure.

FIG. 8 is a flowchart of an embodiment of a method or process 180 for operating the vapor compression system 14, in accordance with the presently-disclosed techniques. As an example, one or more control systems (e.g., the control panel 40) or processing circuitry may be configured to perform the steps of the method 180 (e.g., via instructions stored on the memory 46). Furthermore, it should be noted that the method 180 may be performed differently in alternative embodiments. For example, additional steps may be performed, and/or certain steps of the depicted method 180 may be removed, modified, and/or performed in a different order.

At block 182, one or more operating parameters indicative of a pressure differential within the vapor compression system 14 is received. For instance, the one or more operating parameters may be received via sensor data output by the one or more sensors 122. As an example, the one or more operating parameters may include a pressure differential between the evaporator 38 and the intermediate vessel 70 and/or between the evaporator 38 and the condenser 34. As another example, the one or more operating parameters may include a liquid level of refrigerant (e.g., liquid refrigerant 96, 98, vapor refrigerant) in the intermediate vessel 70, in the condenser 34, in the evaporator 38, and/or in the primary line 108, a respective pressure within the condenser 34, the evaporator 38, the discharge line 94, and/or the intermediate vessel 70, a flow rate and/or pressure of the liquid refrigerant 98 in the primary line 108, a flow rate of the liquid refrigerant 96 through the inlet line 68, an amount of power supplied to a compressor (e.g., the compressor 32), a speed of the compressor, a respective temperature within the condenser 34, the evaporator 38, and/or the intermediate vessel 70, an ambient temperature, a temperature of the cooling fluid within the evaporator 38, a temperature of the conditioning fluid within the condenser 34, another suitable operating parameter, or any combination thereof. Indeed, the one or more operating parameters may indicate whether the liquid refrigerant 98 is flowing into the evaporator 38 at a desirable or target flow rate. At block 184, the one or more operating parameters are compared with a threshold value. The comparison between the one or more operating parameters and the threshold value may indicate whether operation of the vapor compression system 14 is to be adjusted.

At block 186, the expansion valve 36, the expansion valve 66, and/or the bypass valve 120 are operated (e.g., adjusted) based on the comparison between the one or more operating parameters and the threshold value. For instance, a respective target or desirable position of the expansion valve 36, the expansion valve 66, and/or the bypass valve 120 may be determined based on the comparison between the one or more operating parameters and the threshold value. In certain embodiments, any or all of the expansion valve 36, the expansion valve 66, and/or the bypass valve 120 may include on/off valves configured to transition between a fully open position and a fully closed position. In additional or alternative embodiments, any or all of the expansion valve 36, the expansion valve 66, and/or the bypass valve 120 may also be configured to transition into an intermediate position between the fully open position and the fully closed position, such as a partially open or a partially closed position. For instance, the expansion valve 36, the expansion valve 66, and/or the bypass valve 120 may be solenoid valves, and the respective positions of the expansion valve 36, the expansion valve 66, and/or the bypass valve 120 may be based on a received control signal (e.g., from the control panel 40). In any case, sensor data indicative of the respective positions of the expansion valve 36, the expansion valve 66, and/or the bypass valve 120 may be used (e.g., by the control panel 40) to adjust the expansion valve 36, the expansion valve 66, and/or the bypass valve 120 to the corresponding target positions in order to enable desired flows of the liquid refrigerant 96, 98 into the evaporator 38.

By way of example, if the comparison between the one or more operating parameters and the threshold value indicates that the pressure differential (e.g., between the condenser 34 and the evaporator 38) is low (e.g., below a low threshold pressure differential), the vapor compression system 14 (e.g., the expansion valve 36, the expansion valve 66, and/or the bypass valve 120) may be operated to increase the flow of the liquid refrigerant 96, 98 into the evaporator 38, such as by increasing the opening of the bypass valve 120 and/or by decreasing the opening of the expansion valve 36. Similarly, if the comparison between the one or more operating parameters and the threshold value indicates that the pressure differential is high (e.g., above a high threshold pressure differential), the vapor compression system 14 (e.g., the expansion valve 36, the expansion valve 66, and/or the bypass valve 120) may be operated to reduce the flow of refrigerant into the evaporator 38 via the bypass line 100, such as by reducing the opening of the bypass valve 120 and/or by increasing the opening of the expansion valve 36.

In some embodiments, a position of the expansion valve 36 and/or the expansion valve 66 may be adjusted before adjusting a position of the bypass valve 120. For instance, the position of the expansion valve 36 and/or the position of the expansion valve 66 may be adjusted to a respective threshold position (e.g., a fully open position, a fully closed position) before the bypass valve 120 is adjusted. In other words, the bypass valve 120 may not be adjusted until the expansion valve 36 and/or the expansion valve 66 is sufficiently or fully opened or sufficiently or fully closed. For example, the bypass valve 120 may remain closed until the expansion valve 36 and/or the expansion valve 66 are in a fully open position. After the expansion valve 36 and/or the expansion valve 66 have been adjusted to the fully open position, the bypass valve 120 may then be opened, such as at set increments (e.g., 20% of a fully opened size) per interval of time. In additional or alternative embodiments, the expansion valve 36, the expansion valve 66, and/or the bypass valve 120 may be simultaneously adjusted, such as to enable a desired balance of flow of the liquid refrigerant 96, 98 into the evaporator 38 via the first inlet 107 and the second inlet 108. For instance, the opening of the expansion valve 36 and/or of the expansion valve 66 may be reduced while the opening of the bypass valve 120 is increased to increase refrigerant flow through the bypass line 100 (e.g., rather than through the primary line 108) into the evaporator 38.

The present disclosure may provide one or more technical effects to enable improved operation of an HVAC system. For example, the HVAC system may include a vapor compression system configured to circulate a refrigerant. The vapor compression system may include a condenser configured to cool the refrigerant via heat exchange with a conditioning fluid and an evaporator configured to place the cooled refrigerant in a heat exchange relationship with a cooling fluid to cool the cooling fluid. The vapor compression system also includes an intermediate vessel, which may further cool the liquid refrigerant discharged from the condenser and direct the liquid refrigerant to the evaporator. The vapor compression system may include a primary line configured to direct refrigerant into the evaporator from the intermediate vessel and a bypass line configured to direct refrigerant into the evaporator (e.g., from the condenser, from the intermediate vessel).

The bypass line may provide less resistance to flow of the refrigerant into the evaporator than that of the primary line. For example, the primary line may utilize a pressure differential in the vapor compression system (e.g., between the condenser and the evaporator and/or between the intermediate vessel and the evaporator) to direct the refrigerant into the evaporator, and the bypass line may utilize a gravitational force to direct the refrigerant into the evaporator. In some embodiments, the bypass line enables flow of refrigerant into the evaporator without the refrigerant overcoming a gravitational force and/or by overcoming less gravitational force than refrigerant directed into the evaporator via the primary line. Thus, during certain operation conditions, such as when refrigerant is not being directed into the evaporator at a target or desirable flow rate via the primary line and/or during low pressure differential conditions in the vapor compression system, the bypass line (e.g., a bypass valve of the bypass line) may be operated to increase the flow rate of the refrigerant into the evaporator via the bypass line toward the target flow rate. The presently disclosed techniques may also be utilized in additional or alternative operating conditions of the vapor compression system, such as during periods of liquid refrigerant stagnation within the vapor compression system (e.g., within the primary line), during fluctuation of head or discharge pressure, during fluctuation of liquid refrigerant levels within the condenser, and so forth. The technical effects and technical problems in the specification are examples and are not limiting. It should be noted that the embodiments described in the specification may have other technical effects and can solve other technical problems.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures), mounting arrangements, use of materials, colors, orientations) without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the present disclosure, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and/or air conditioning (HVAC) system, comprising:

a vessel configured to receive refrigerant from a condenser of the HVAC system;

an evaporator configured to receive the refrigerant from the vessel;

a first conduit configured to direct a first flow of the refrigerant to a first inlet of the evaporator, wherein the first inlet is disposed at a bottom section of the evaporator; and a second conduit configured to direct a second flow of the refrigerant to a second inlet of the evaporator, wherein the second inlet is above the first inlet relative to a vertical axis.

2. The HVAC system of claim 1, comprising a third conduit extending from the condenser to the vessel, wherein the third conduit comprises an expansion valve configured to reduce a pressure of the refrigerant directed from the condenser to the vessel to enable separation of the refrigerant into liquid refrigerant and vapor refrigerant within the vessel.

3. The HVAC system of claim 2, comprising an outlet conduit extending from the vessel and configured to direct the liquid refrigerant from the vessel toward the evaporator, wherein each of the first conduit and the second conduit extends from the outlet conduit.

4. The HVAC system of claim 2, comprising:

an outlet conduit configured to discharge the refrigerant from the condenser; and an inlet conduit extending from the outlet conduit to the vessel, wherein the first conduit extends from the outlet conduit to the evaporator to enable refrigerant bypass of the vessel, and the second conduit extends from the vessel to the evaporator.

5. The HVAC system of claim 1, wherein the first conduit comprises a bypass valve, the HVAC system comprises a controller communicatively coupled to the bypass valve, and the controller is configured to operate the bypass valve based on an operating parameter indicative of a pressure differential within the HVAC system.

6. The HVAC system of claim 1, wherein the evaporator is a hybrid falling film and flooded evaporator.

7. A heating, ventilation, and/or air conditioning (HVAC) system, comprising:

a vessel configured to receive refrigerant from a condenser and to separate the refrigerant received from the condenser into vapor refrigerant and liquid refrigerant;

a first conduit configured to direct a first flow of liquid refrigerant to a first inlet of an evaporator of the HVAC system, wherein the first conduit comprises a bypass valve, and the first inlet is disposed at a bottom section of the evaporator;

a second conduit configured to direct a second flow of liquid refrigerant to a second inlet of the evaporator, wherein the second inlet is above the first inlet relative to a vertical axis; and a controller communicatively coupled to the bypass valve, wherein the controller is configured to operate the bypass valve to control a flow rate of the first flow of liquid refrigerant to the evaporator via the first conduit.

8. The HVAC system of claim 7, comprising the evaporator, wherein the second conduit extends to a top section of the evaporator, and the controller is configured to close the bypass valve to operate the evaporator as a falling film evaporator.

9. The HVAC system of claim 7, comprising the evaporator, wherein the second conduit comprises an expansion valve configured to reduce a pressure of the second flow of liquid refrigerant directed through the second conduit, and the controller is configured to close the expansion valve to operate the evaporator as a flooded evaporator.

10. The HVAC system of claim 7, wherein the controller is configured to operate the bypass valve based on an operating parameter indicative of a level of the liquid refrigerant in the vessel, a liquid level of the refrigerant in the condenser, a liquid level of the refrigerant in the evaporator, a level of the second flow of liquid refrigerant in the second conduit, a pressure within the condenser, a pressure within the evaporator, a pressure within the vessel, a flow rate of the second flow of liquid refrigerant through the second conduit, a temperature within the condenser, a temperature within the evaporator, a temperature within the vessel, an ambient temperature, an amount of power supplied to a compressor of the HVAC system, a speed of the compressor, or any combination thereof.

11. The HVAC system of claim 7, comprising the condenser and a compressor, wherein the compressor is configured to receive refrigerant from the evaporator, pressurize the refrigerant, and direct the refrigerant to the condenser.

12. The HVAC system of claim 11, wherein the controller is configured to suspend operation of the compressor or operate the compressor at a reduced capacity based on a temperature within the condenser being below a threshold value.

13. The HVAC system of claim 11, wherein the compressor is a first compressor configured to receive vapor refrigerant from the vessel, pressurize the vapor refrigerant, and direct the pressurized vapor refrigerant to the condenser, and the HVAC system comprises a second compressor configured to receive vapor refrigerant from the vessel, pressurize the vapor refrigerant, and direct the pressurized vapor refrigerant to the condenser.

14. A heating, ventilation, and/or air conditioning (HVAC) system, comprising:

a condenser;

an intermediate vessel configured to receive refrigerant from the condenser;

an evaporator configured to receive the refrigerant from the intermediate vessel;

a first conduit extending between the condenser and the intermediate vessel, wherein the first conduit comprises an expansion valve configured to reduce a pressure of the refrigerant directed through the first conduit to enable separation of the refrigerant into liquid refrigerant and vapor refrigerant within the intermediate vessel;

a second conduit extending between the intermediate vessel and a first inlet of the evaporator, wherein the second conduit is configured to direct the liquid refrigerant into the evaporator via the first inlet, and the first inlet is disposed at a bottom section of the evaporator; and a third conduit extending between the intermediate vessel and a second inlet of the evaporator, wherein the second inlet is above the first inlet relative to a vertical axis, and the third conduit is configured to direct the liquid refrigerant into the evaporator via the second inlet.

15. The HVAC system of claim 14, wherein the second conduit comprises a bypass valve configured to control a flow rate of the liquid refrigerant directed through the second conduit, and the third conduit comprises an additional expansion valve configured to reduce a pressure of the liquid refrigerant directed through the third conduit.

16. The HVAC system of claim 15, comprising a controller communicatively coupled to the expansion valve, the additional expansion valve, and the bypass valve, wherein the controller is configured to control the expansion valve, the additional expansion valve, the bypass valve, or any combination thereof, based on an operating parameter indicative of a flow rate of the liquid refrigerant into the evaporator.

17. The HVAC system of claim 14, comprising a fourth conduit configured to discharge the liquid refrigerant from the intermediate vessel, wherein each of the second conduit and the third conduit extends between the fourth conduit and the evaporator.

18. The HVAC system of claim 14, wherein the first inlet is positioned beneath a tube bundle within the evaporator relative to the vertical axis, and the second inlet is positioned above the tube bundle relative to the vertical axis.

* * * * *